United States Patent [19]

Feuling

[11] Patent Number: 5,042,435

[45] Date of Patent: Aug. 27, 1991

[54] MANIFOLD FOR AN INTERNAL COMBUSTION ENGINE USING MULTIPLE CARBURETORS

[75] Inventor: James J. Feuling, Ventura, Calif.

[73] Assignee: Feuling Engineer, Inc., Ventura, Calif.

[21] Appl. No.: 632,914

[22] Filed: Dec. 24, 1990

[51] Int. Cl.[5] ..... F02M 35/10

[52] U.S. Cl. ..... 123/52 MV; 123/579

[58] Field of Search ..... 123/52 M, 52 MV, 579, 123/580, 581

[56] References Cited

U.S. PATENT DOCUMENTS

| | | | |
|---|---|---|---|
| 1,541,851 | 6/1925 | Ristau | 123/579 |
| 4,072,139 | 2/1978 | Miyazawa | 123/579 |
| 4,671,216 | 6/1987 | Itoh | 123/52 MV |
| 4,686,944 | 8/1987 | Hiraoka et al. | 123/52 MV |
| 4,862,839 | 9/1989 | Bridges | 123/52 MV |
| 4,934,342 | 6/1990 | Tamba et al. | 123/52 MV |

FOREIGN PATENT DOCUMENTS

| | | | |
|---|---|---|---|
| 0072229 | 6/1981 | Japan | 123/579 |
| 0016254 | 1/1982 | Japan | 123/579 |
| 0301951 | 12/1989 | Japan | 123/579 |

*Primary Examiner*—David A. Okonsky

*Attorney, Agent, or Firm*—Frank D. Gilliam

[57] ABSTRACT

An intake manifold for twin carburetors or twin air control throat bodies for a motorcycle or the like having one or more cylinders where the physical space is limited comprising a hollow central plenum chamber and hollow carburetor or air control throat body mounting flanges on each opposing side adjacently perpendicular to at least one side communicating with the intake track of at least one cylinder. In the case of two opposing cylinders, each cylinder communicates with the hollow central plenum chamber through opposing openings and the perpendicularly mounted carburetors or air control bodies. When a cylinder intakes a fuel mixture from the carburetors the fuel mixtures from each carburetor converge in the hollow plenum chamber where the direction of flow is turned toward the cylinder without physical impact with a physical structure during direction change. With the cause of air control throat bodies the air flowing through the manifold controls the flow of the air in the same manner as the fuel mixture.

9 Claims, 1 Drawing Sheet

MANIFOLD FOR AN INTERNAL COMBUSTION ENGINE USING MULTIPLE CARBURETORS

BACKGROUND OF THE INVENTION

The invention is directed to intake manifolds for internal combustion engines and more particularly to intake manifolds for use on single or multi-cylinder internal combustion engines utilizing multiple carburetors or multiple air control throat bodies.

When multiple carburetors are utilized on high output engines, the intake manifold is usually convoluted with resulting flow losses and air/fuel separation, Particularly in the case of multi-cylinder engines with multiple carburetors feeding multiple cylinders.

Velocity changes and flow losses cause loss of throttle response, fuel efficiency, and power. Large passages ad extensive wetted surfaces cause high emission levels and poor idle quality.

There has not been a suitable and efficient intake manifold for single or multi-cylinder engines employing multiple carburetors or multiple air control bodies until the emergence of the manifold of this invention.

SUMMARY OF THE INVENTION

The invention is directed to the adaption of multiple carburetors or multiple intake air control throat bodies to a small confined area of a motor vehicle, namely, a motorcycle or other vehicles that employ similarly designed engines for various purposes.

The intake manifold of the invention comprises a box like plenum chamber having two opposed flanges each configured to accept a conventional carburetor for blending liquid fuel and air into a combustible mixture of fueling an internal combustion engine or an intake air control throat body used with fuel injection systems to control incoming air. At least one of the adjacent sides of the intake manifold of the present invention is open for engagement with an intake port allowing a combustible mixture from the carburetors or air from a air control throat body to be drawn into an engine cylinder. In the case of a twin or multiple cylinder engine both opposing sides of the plenum chamber are open to a different juxtaposed cylinder. The adjacent sides of the manifold are angled inward toward the bottom surface to accommodate the angle of twin cylinders of an engine positioned in a generally "V" configuration. A partially open grove is provide around the periphery of the adjacent sides that abut the cylinder or cylinders to allow for a sealing gasket such, as for example, an "O" ring between the cylinders and manifold. In a twin cylinder engine with the carburetors or air control throat bodies removed from the intake manifold of the present invention a longitudinally aligned opening through the opposing flanges of the manifolds is present. In operation when installed on a single or multiple cylinder engine, the cylinder having its intake stroke draws combustible fuel from each of the opposed carburetors of air from each of the opposed air control throat bodies toward the center of the intake manifold of the present invention between the opposed carburetors or air control bodies where the incoming combustible air/fuel mixture from the opposing carburetors or air from the opposing air control throat bodies impact, and due to their substantially identical flow rates are dynamicly cause the air of air/fuel mixture to turn into the operating cylinder without substantial loss in initial flow rates. The combined flow from the carburetors or air from the air control throat bodies is then drawn in a direction perpendicularly to its initial flow into the operating cylinder.

An object of this invention is to provide a more fuel efficient intake manifold for multiple carburetors or air control throat bodies for vehicle engines that have a minimal physical space to accommodate multiple carburetors or air control throat bodies.

Another object of this invention is to provide a visual line of sight between the longitudinal opening in the flanges to which the carburetors or air control throat bodies are attached when the carburetors or air control throat bodies are removed therefrom.

Another object of this invention is to create a dynamic pressure barrier between the combustible fuel and air mixture of the opposed carburetors or the air from the opposed air control throat bodies to facilitate a smooth and continuous dynamic change of direction of that flow into the engine cylinder which is pulling in a charge.

A still further object of this invention is to provide a a multiple carburetor or multiple air control throat body manifold that can be accommodated between the cylinders of a internal combustion engine.

A still further object of this invention is to provide a multiple carburetor or air control throat body manifold that can be used on either single or multiple cylinders of an internal combustion engine.

Yet another object of this invention is to provide a sealed connection between the intake manifold of the present invention and the cylinder to which they are associated.

Yet another object of this invention is to provide a flow of combustible vaporized fuel of air into a cylinder without using a solid wall to redirect that flow from a first initial direction of flow to a second direction of flow.

Yet another object of this invention is to substantially eliminate any droplets of liquid fuel collecting along the intake track from the carburetors to the engine intake tract.

Yet still another object of this invention is to provide an intake manifold for multiple carburetors or air control throat bodies having improved atomization and a better air-fuel mixture than the present intake manifolds utilized for the same purpose.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

DETAILED DESCRIPTION OF THE PREFERRED EMBODIMENT OF THE INVENTION

It should be understood that the reference throughout this description the term carburetor also includes the air control throat body of a fuel injected engine fuel system as the devices are interchangeable with relation to the invention herein.

The twin carburetor or twin air control throat body manifold of the present invention can be used equally as well for single cylinder or twin cylinder internal combustion engines. The following discussion is directed to twin cylinder engines for ease of discussion and not by way of limitation. It should be understood that the invention applies equally as well to single cylinder engines wherein one side opening of the plenum chamber 8 either has an integral wall or a plate is secured thereto in a sealed relationship to cover the opening.

Figure 1:
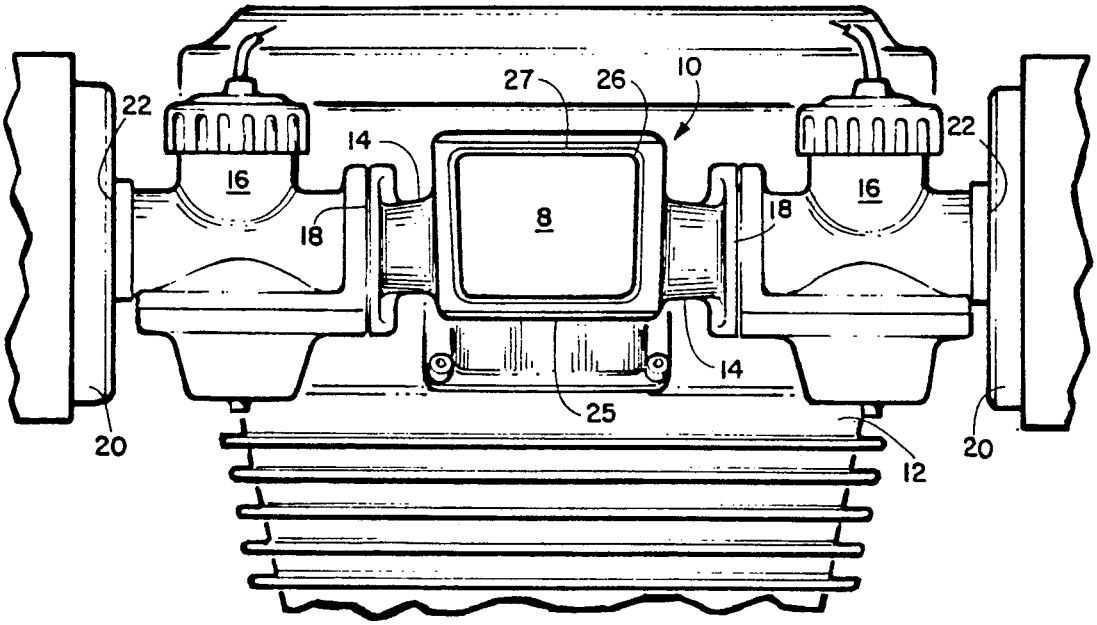
FIG. 1 is a partial cutaway showing of the intake manifold of the present invention attached to one cylinder of a twin cylinder internal combustion engine with the second foreground cylinder removed for clarity.

Referring now specifically to drawing FIG. 1 which depicts the intake manifold 10 of the present invention. In the drawing FIG. 1, the engine cylinder in the foreground has been removed for clarity in the discussion of the present invention. A second cylinder 12 is shown in the background of the drawing with the manifold 10 attached thereto with the surface of the manifold facing the viewer open. The manifold 10 is shown with two opposiing carburetor or air control throat body attachment flanges 14 connected to the plenum chamber 8. A pair of carburetors or air control throat bodies 16 are shown in position attached the distal end surface 18 of the flanges 14. Air cleaners 20 are showm attached to the distal end surfaces 22 of the carburetors or air control throat bodies 16.

Figure 2:
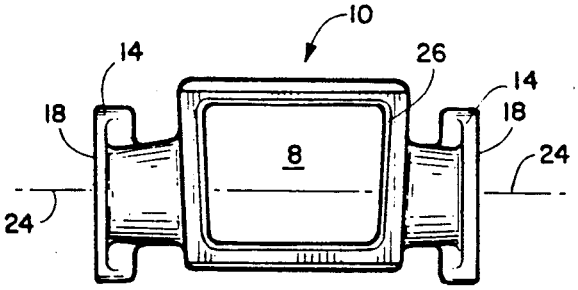
FIG. 2 is a side view showing of the intake manifold of the present invention removed from the engine.
Figure 3:
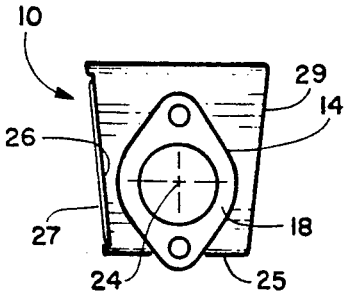
FIG. 3 is an end view of the intake manifold of drawing FIG. 2 showing one of the two carburetor or air control body attachment flanges with one cylinder side opening closed to accommodate a single cylinder engine.
Figure 4:
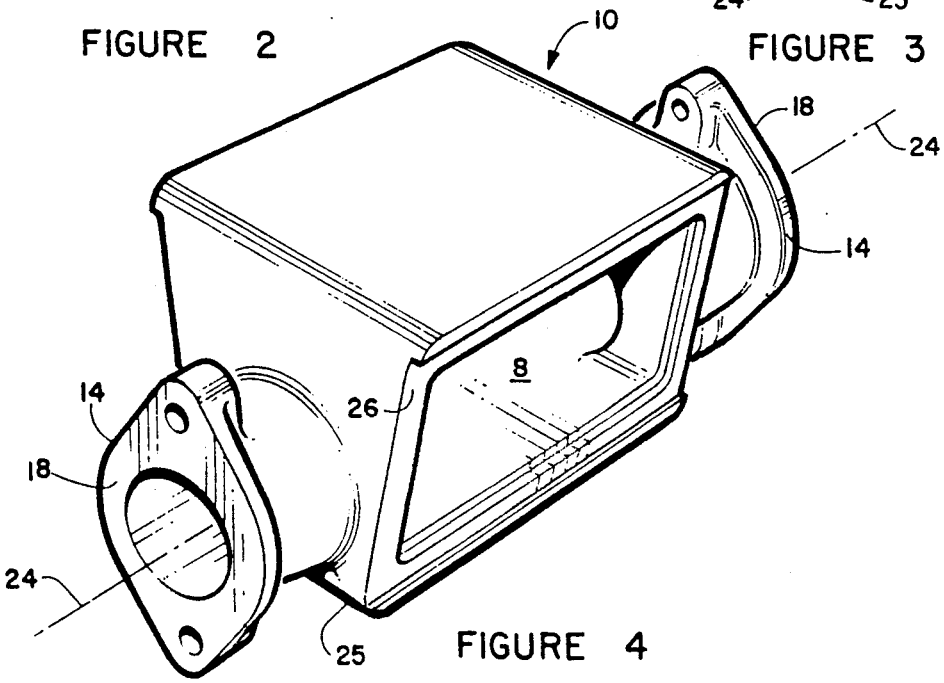
FIG. 4 is a perspective showing of the intake manifold of the present invention for twin cylinder engines as seen in FIG. 1.

Referring now to the drawing FIGS. 2-4, FIG. 2 is a showing similar to the showing of the manifold of the invention in FIG. 1. The longitudinal center line 24 through the flanges 14 and central body plenum portion 8 of the intake manifold 10 is shown. With the carburetors or air control throat bodies removed, as shown in FIGS. 2-4, an opening straight through the manifold is provided. As can be seen in drawing FIGS. 3 and 4, the sides of the plenum chamber 8 of the manifold 10 of the present invention are angled inward toward the bottom surface 25 in the general form of a trapezoid so as to make a sealed fit with the angle of the cylinder or cylinders relative to a true vertical plane. The angle of the manifold is determined by the angle between the cylinders. An integral formed end surface or a removable plate 29 may be used to seal either one of the side openings in the plenum chamber when the manifold of the invention if to be used on a single cylinder engine.

In drawing FIGS. 1-4 a partial cutaway area 26 for receiving a sealing gasket 27 (see drawing FIGS. 1 and 3) such as, for example, an "O" ring for providing an fuel tight seal between the abutting surfaces of the intake manifold and engine cylinder is shown.

With the intake manifold of the present invention installed on an engine between a pair of juxtapositioned cylinders, the cylinder or its intake stroke creates a vacuum and draws atmospheric air into the carburetors where it mixes with liquid fuel to form a vaporized combustible mixture or into air control throat bodys where the intake flow is controlled for blending with injected fuel. In the carburetor system, the fuel mixture flows from each of the two opposing carburetors into the plenum chamber where the incoming mixtures meet, and are dynamically forced to continue flow through a turn of about 180 degrees within the plenum chamber. The combined combustible fuel is then drawn into the cylinder or cylinders. In this manner an efficient transition from the carburetors to the cylinder or cylinders is accomplished minimizing any mechanical barriers to the fuel flow or loss of substantial flow inertia. In fuel injection systems the proper amount of air is caused to flow in the same manner from the control throat bodies as the combustible mixture flows from the carburetors.

It should be clear that the present invention is well adapted to carry out the objects and attain the ends and advantages mentioned as well as those inherent therein. While the presently preferred embodiment of the invention have been described for purposes of this disclosure, numerous changes may be made which will readily suggest themselves to those skilled in the art and which are emcompassed within the spirit of the invention disclosed and as defined in the appended claims.

What is claimed is:

1. An intake manifold for an internal combustion engine having at least one cylinder comprising:

a hollow chamber communicating with said at least one cylinder for mating thereto and a pair of mounting flanges on opposite sides of said hollow chamber with open centers thereof communicating with said hollow chamber whereby a longitudinal center line through said open centers pass through said hollow chamber providing a line of sight therethrough.

2. The intake manifold as defined in claim 1 wherein said engine comprises a pair of juxtaposed cylinders and said hollow chamber communicates with said juxtaposed cylinders through sides adjacent said respective cylinders, said sides being normal to said open centers of said mounting flanges.

3. The intake manifold of claim 2 wherein said sides converge toward a bottom surface of said hollow chambers.

4. The intake manifold of claim 2 wherein said sides, when viewed from said flange end thereof in part form a trapezoid.

5. The intake manifold of claim 1 wherein having a side adjacent said cylinder, said side including means for providing a sealing relationship with said cylinder.

6. The intake manifold of claim 1 wherein said communication with said cylinders is provided by a rectangular opening.

7. The manifold of claim 1 wherein said open centers are tubular.

8. An intake manifold for an internal combustion engine having adjacent cylinders with adjacent intake tracts comprising:

a hollow chamber with open angled sides for mating said chamber with said adjacent cylinders in a sealed relationship therewith;

a pair of mounting flanges on opposite sides of said hollow chamber with open centers thereof communicating with said hollow chamber; and a carburetor mounted on each flange whereby when one of said adjacent cylinders of said internal combustion engine draws in a combustible mixture from said carburetors, the incoming mixture from each carburetor to said manifold converges in said hollow chamber, are combined and dynamically directed toward said one of said cylinders.

9. An intake manifold for an internal combustion engine having twin adjacent cylinders with adjacent intake tracks comprising:

a hollow chamber with open angled sides for mating said chamber with said adjacent cylinders in a sealed relationship therewith;

a pair of mounting flanges on opposite sides of said hollow chamber with open centers thereof communicating with said hollow chamber; and an air control throat body mounted on each flange whereby when one of said adjacent cylinders of said internal combustion engine draws in a controlled amount of air from said air control throat body the imcoming air from each air control throat body to said manifold converges in said hollow chamber, combines and is continually directed dynamically toward said one of said cylinders.

* * * * *